United States Patent [19]

Goldman

[11] 4,199,640

[45] Apr. 22, 1980

[54] DECORATIVE FABRIC AND METHOD OF MAKING THE SAME

[76] Inventor: Daniel S. Goldman, c/o The Synthetics Group Two Bala Cynwyd Plz., Bala Cynwyd, Pa. 19004

[21] Appl. No.: 951,179

[22] Filed: Oct. 13, 1978

Related U.S. Application Data

[63] Continuation-in-part of Ser. No. 942,432, Sep. 14, 1978.

[51] Int. Cl.[2] ..... B32B 3/02

[52] U.S. Cl. ..... 428/192; 156/148; 428/114; 428/297; 428/300; 428/301

[58] Field of Search ..... 428/292, 294, 295, 300, 428/301, 297, 192, 114, 85, 88, 91; 156/148; 28/107, 109, 112

[56] References Cited

U.S. PATENT DOCUMENTS

| | | | |
|---|---|---|---|
| 1,608,102 | 11/1926 | Jury | 428/295 |
| 3,097,413 | 7/1963 | Draper | 28/110 |
| 3,126,312 | 3/1964 | Nickerson | 428/295 |
| 3,126,312 | 3/1964 | Nickerson | 428/295 |
| 3,208,125 | 9/1965 | Hall et al. | 28/114 |
| 3,216,082 | 11/1965 | Goy | 28/110 |
| 3,287,786 | 11/1966 | Goy | 28/110 |
| 3,472,730 | 10/1969 | Frigstad | 428/295 |
| 3,538,564 | 11/1970 | Skoler et al. | 28/109 |
| 3,756,893 | 9/1973 | Smith | 28/107 |
| 4,061,819 | 12/1977 | Barnes | 428/295 |

FOREIGN PATENT DOCUMENTS

| | | | |
|---|---|---|---|
| 556696 | 4/1958 | Canada | 428/295 |

*Primary Examiner*—James J. Bell

*Attorney, Agent, or Firm*—Zachary T. Wobensmith, 2nd; Zachary T. Wobensmith, III

[57] ABSTRACT

A decorative fabric and method of making the same is described, the fabric having a layer of longitudinal face yarns, the face yarns being connected at their edges by passage through a needle loom, and the face yarns and the fiber ends extending through the back being held in place by a retaining coating applied to the back. In making the fabric, the longitudinal face yarns are arranged in flat side by side relation, and then advanced through a needle loom for adherence, and the fabric is then bonded by application of a polymeric adhesive backing.

10 Claims, 2 Drawing Figures

DECORATIVE FABRIC AND METHOD OF MAKING THE SAME

CROSS REFERENCE TO RELATED APPLICATIONS

This application is a continuation in part of my prior application for Decorative Fabric and Method Of Making the Same, filed Sept. 14, 1978, Ser. No. 942,432.

BACKGROUND OF THE INVENTION

1. Field of the Invention

This invention relates to decorative fabrics of flat aligned face yarns and method of making the same.

2. Background of the Prior Art

It has heretofore been proposed as shown in the U.S. Pat. Nos. to Heaton, 667,699, Dougherty, 3,217,779, Kiernan et al., 3,935,046, Ripley, 2,381,184, Skoler, 3,538,564, Jackson, 3,551,265, and Smith, 3,756,893, to join a plurality of textile fabrics, or yarns and textile fabrics or warp yarns and weft yarns by passing the same through a needle loom or needle punching machine.

It has heretofore been proposed to apply backings of latex and the like to retain the integrity of the fabric, examples being shown in the U.S. Pat. Nos. to Levin, 1,774,204, Robertson et al., 1,815,586, Merriman et al., 3,321,356, and Skoler, 3,538,564.

None of the prior art patents referred to above discloses a decorative fabric in which the exposed surface subject to wear is completely of warp yarns with scuff resistance and as well as being of attractive appearance, and in which the warp yarns cover a backing of a retaining coating, which is particularly suitable for a decorative covering for a panel or other supporting surface and which has acoustical transparency, nor the methods hereinafter set forth of making such a fabric.

SUMMARY OF THE INVENTION

In accordance with the invention a decorative fabric is provided which is particularly suited for use as a decorative covering for wall panels or partitions together with methods of making the same, the fabric having an upper and exposed layer of longitudinal face yarns arranged side by side, the layer of face yarns being connected at the sides or edges of the yarns by passage through a needle loom and with fibers carried through the face yarns, the portions of the yarns exposed on the back being held in place by a retaining coating applied to the back.

It is the principal object of the invention to provide a decorative fabric which is particularly suitable and acceptable for use as a covering for wall panels or partitions and in which the exposed surface is composed entirely of warp yarns.

It is a further object of the invention to provide a decorative fabric of the character aforesaid in which the exposed surface can be varied over a wide range of types, kinds and colors of yarns to provide a wide variety of decorative effects.

It is a further object of the invention to provide a decorative fabric of the character aforesaid in which the longitudinal face yarns are secured together to and with a rear protective and retaining coating which is not subject to the ravages of water or moisture.

It is a further object of the invention to provide a decorative fabric of the character aforesaid which can be rapidly made and at reduced cost as compared with fabrics now available for the same uses.

It is a further object of the invention to provide improved methods for making a decorative fabric.

Other objects and advantageous features will be apparent from the description and claims.

BRIEF DESCRIPTION OF THE DRAWINGS

The nature and characteristic features of the invention will be more readily understood from the following description taken in connection with the accompanying drawings forming part hereof in which.

It should, of course, be understood that the description and drawings herein are illustrative merely and that various modifications and changes can be made in the methods and fabric disclosed without departing from the spirit of the invention.

Like numerals refer to like parts throughout the several views.

DESCRIPTION OF THE PREFERRED EMBODIMENTS

Figure 1:
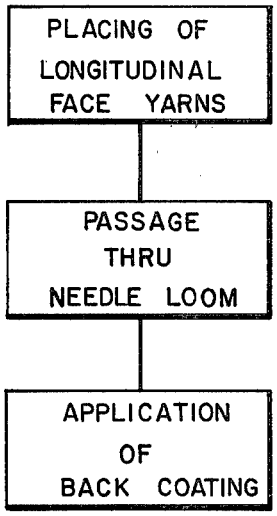
FIG. 1 is a diagram showing the steps in connection with the preparation of the fabric shown in FIG. 2.

Referring first to FIG. 1 of the drawings the initial step is the advancing of the face yarns in a plane and in a longitudinal direction. The face yarns are of the decorative type, can be bulky, thick and thin, slub, novelty, or boucles, as desired, preferably plied yarns from spun or single strands, or bulked continuous filament yarns known as textured yarns. If bulky yarns are employed they may be arranged 4 to 7 to the inch, if medium yarns are employed they may be 8 to 15 to the inch, and if fine yarns are employed they may be 16 to 30 to the inch, and accordingly can range from 300 yards to the pound to 2,000 yards to the pound.

The longitudinal face yarns are preferably advanced as close together as possible without overcrowding, in the same plane, and touching at their sides.

The longitudinal face yarns in flat condition and close together are passed through a needle loom. A needle density in the range from 90 to 117 per inch is suitable. A 90 density board, i.e. one having 90 needles to the inch on a width of 11-$\frac{5}{8}$ inches has been found satisfactory.

The needles are preferably those known as gentle needles, are directional and pull out clean, the thickness of the yarn determining to at least some extent the relative harshness of the needles. In the advance through the needle loom the penetrations per square inch of the yarns is in the range of 200 to 600 penetrations per inch, a range of 300 to 400 being preferred and at a rate of about 700 per minute. The thickness of the yarns will also determine the depth of penetration which preferably is in the range from one quarter to three quarters of an inch. The action of the needle loom is to unite the face yarns at their edges without any considerable change in the appearance of the face yarns, and with transfer of fibers therethrough and away from the exposed face. The yarn system is very fragile at this stage and cannot be handled manually.

Immediately subsequent to the needling operation a bonding coating is applied to the back of the longitudinal face yarns, is dried, which coating may be of latex emulsions, solvent solutions, acqueous or solvent dispersions, hot melt or other suitable binders. The back coating can be applied as a spray, with a roller or knife, in any desired manner, and may be colored to conform substantially to the color of the face yarns or may be of a contrasting or modifying color. The fabric as herein described can be made at a rate of the order of five to six yards per minute.

Figure 2:
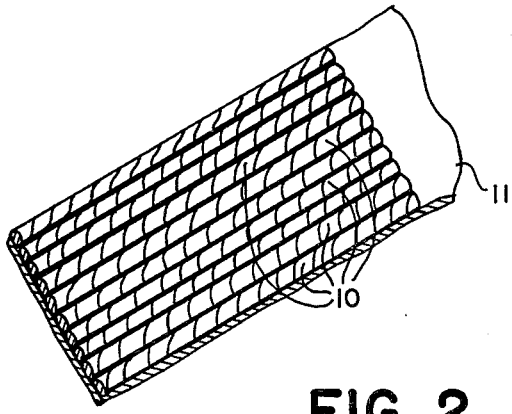
FIG. 2 is a view in perspective of the fabric of the invention, a layer being removed to show the details of construction.

Referring now to FIG. 2, a piece of fabric in accordance with the invention is there shown with the longitudinal face yarns shown at 10 retained by the back bonding coating 11.

The fabric produced as herein described consists essentially of decorative longitudinal or warp yarns on and second to a bonding back coating with the longitudinal yarns providing the exposed surface, which is strong in the machine direction but sufficiently strong in the transverse direction for purposes of application to supporting structures, which has accoustical transparency, which has an attractive appearance, which can be made rapidly at low cost and which is suitable for a variety of uses, including adherent attachment to decorative wall panels.

I claim:

1. A decorative fabric comprising longitudinal decorative face yarns in a flat side by side continuous disposition providing the exposed face of the fabric, said face yarns having fibers thereof disposed therethrough and exposed on the rear of the face yarns and being joined along their longitudinal edges by fibers of adjoining yarns, and a bonding coating on the exposed lower face of the face yarns and in engagement with said lower face and said fibers at said lower face and retaining the integrity of the fabric.

2. A decorative fabric as defined in claim 1 in which the face yarns are in the range from 4 to 30 to the inch.

3. A decorative fabric as defined in claim 1 in which the face yarns are bulky and in the range from 4 to 8 to the inch.

4. A decorative fabric as defined in claim 1 in which the face yarns are of medium size and in the range from 8 to 15 to the inch.

5. A decorative fabric as defined in claim 1 in which the face yarns are relatively fine and in the range from 16 to 30 to the inch.

6. The method of making a decorative fabric which comprises continuously advancing a flat layer of longitudinally disposed decorative face yarns in side by side and edge contacting arrangement, passing the face yarns through a needle loom for joining the face yarns at their longitudinal edges, and applying a bonding coating to the back of the face yarns to retain the integrity of the fabric.

7. The method defined in claim 6 in which during the passage of the face yarns through the needle loom fibers of the face yarns are advanced to the back, and the bonding coating is also applied to the fibers so advanced.

8. The method defined in claim 6 in which the face yarns are in the range from 4 to 30 to the inch.

9. The method defined in claim 6 in which the needling is effected in the range from 200 to 600 penetrations per inch.

10. The method defined in claim 6 in which the needle penetration is in the range from one quarter to three quarters of an inch.

* * * * *

UNITED STATES PATENT OFFICE

CERTIFICATE OF CORRECTION

Patent No. 4,199,640 Dated April 22, 1980

Inventor(s) Daniel S. Goldman

It is certified that error appears in the above-identified patent and that said Letters Patent are hereby corrected as shown below:

Column 3,
Line 14, after "and" delete "second" and insert - secured -

Signed and Sealed this

*Fifteenth* Day of *July 1980*

[SEAL]

*Attest:*

SIDNEY A. DIAMOND

*Attesting Officer* *Commissioner of Patents and Trademarks*